US012085364B2

(12) United States Patent
Mason

(10) Patent No.: US 12,085,364 B2
(45) Date of Patent: Sep. 10, 2024

(54) VARIABLE RANGE BOW SIGHT MOUNTING ASSEMBLY

(71) Applicant: Gregory E. Summers Trust Agreement dated December 8, 2006, Madison Heights, VA (US)

(72) Inventor: Tristan Mason, Madison Heights, VA (US)

(73) Assignee: Veritas 2, LLC, Madison Heights, VA (US)

( * ) Notice: Subject to any disclaimer, the term of this patent is extended or adjusted under 35 U.S.C. 154(b) by 56 days.

(21) Appl. No.: 18/061,137

(22) Filed: Dec. 2, 2022

(65) Prior Publication Data

US 2024/0183637 A1 Jun. 6, 2024

(51) Int. Cl.
*F41G 1/467* (2006.01)

(52) U.S. Cl.
CPC ..... *F41G 1/467* (2013.01)

(58) Field of Classification Search
CPC ..... F41G 1/467; F41B 5/14
USPC ..... 124/86, 87; 33/265
See application file for complete search history.

(56) References Cited

U.S. PATENT DOCUMENTS 4,142,297 A * 3/1979 Altier ..... F41G 1/467 33/265
4,317,288 A * 3/1982 Yasui ..... F41G 1/467 33/265
4,535,747 A * 8/1985 Kudlacek ..... F41G 1/467 124/87
4,567,668 A * 2/1986 King ..... F41G 1/467 33/265
4,761,888 A * 8/1988 Kudlacek ..... F41G 1/467 42/137
5,048,193 A * 9/1991 Hacquet ..... F41G 1/467 D22/107
5,050,576 A * 9/1991 Larson ..... F41G 1/467 124/87
5,072,716 A * 12/1991 Sappington ..... F41G 1/467 124/87
5,131,153 A * 7/1992 Seales ..... F41G 1/467 124/87
5,174,269 A * 12/1992 Sappington ..... F41G 1/467 124/87
5,285,767 A * 2/1994 Padilla ..... F41B 5/1426 124/80
5,379,746 A * 1/1995 Sappington ..... F41G 1/467 124/87
5,394,859 A * 3/1995 Janeway ..... F41G 1/467 411/386
5,400,764 A * 3/1995 Spolar ..... F41G 1/467 124/87

(Continued)

*Primary Examiner* — Alexander R Niconovich
(74) *Attorney, Agent, or Firm* — Leading Edge Law Group, PLC

(57) ABSTRACT

A variable range bow sight mounting assembly for an archery sight includes an elevation bar for connection with a bow and a mounting bracket configured for adjustable connection with the elevation bar. The mounting bracket contains a channel configured to receive an extension bar for sliding movement of the bar relative to the mounting bracket. The elevation bar contains a plurality of spaced openings with which the mounting bracket may be selectively connected to vertically position a sight aperture at the remote end of the extension bar as desired by the archer.

14 Claims, 6 Drawing Sheets

(56) References Cited

U.S. PATENT DOCUMENTS

| | | | | | |
|---|---|---|---|---|---|
| 5,428,901 | A * | 7/1995 | Slates | F41G 1/467 | 124/87 |
| 5,507,272 | A * | 4/1996 | Scantlen | F41G 1/467 | 124/87 |
| 5,524,601 | A * | 6/1996 | Slates | F41B 5/1426 | 124/87 |
| 5,941,226 | A * | 8/1999 | Marietta | F41G 1/467 | 124/87 |
| 6,430,822 | B1 * | 8/2002 | Slates | F41G 1/467 | 124/87 |
| 6,446,347 | B1 * | 9/2002 | Springer | F41G 1/467 | 124/87 |
| 6,802,129 | B1 * | 10/2004 | Wirth | F41G 1/467 | 124/87 |
| 6,851,197 | B2 * | 2/2005 | Terry | F41G 1/467 | 33/286 |
| 9,612,087 | B2 * | 4/2017 | Summers | F41G 1/467 | |
| 11,698,243 | B2 * | 7/2023 | Mason | F41G 1/467 | 33/265 |
| 2019/0390937 | A1 * | 12/2019 | Mason | F41G 1/467 | |
| 2021/0207927 | A1 * | 7/2021 | Yasui | F41B 5/148 | |
| 2023/0021845 | A1 * | 1/2023 | Yasui | F41B 5/1426 | |

* cited by examiner

VARIABLE RANGE BOW SIGHT MOUNTING ASSEMBLY

BACKGROUND OF THE INVENTION

Archery sights are used by hunters and competition archers to increase the accuracy of a shot. The sights may be attached directly to a bow but are more typically mounted on a sight elevation rail which in turn is connected with an extension bar. A bow mount or mounting bracket is used to connect the extension bar with the bow. The extension bar is adjustable relative to the bow mount to properly position the sight aperture closer to or farther away from the archer.

In archery competitions, targets may be arranged at a fixed distance from the archer or at multiple distances. Variable distance competitions require adjusting the position of the sight aperture along the elevation rail depending on the distance to the target. To accommodate the various distances, the elevation rail must have an extended length for proper positioning of the sight aperture. The extended length adds weight to the target end of the sight mounting system.

There are also different archery disciplines, namely recurve and compound. These disciplines typically require different types of bows. Recurve archers are not allowed to use a release aid whereas compound archers may use a release aid.

BRIEF DESCRIPTION OF THE PRIOR ART

Archery sight bow mounts for connecting a sight extension bar with a bow are well-known in the art. The prior mounts are typically fixed to the bow and configured to receive the sight extension bar. The prior mounts include a threaded opening which receives a screw having a knob at one end. Tightening of the knob presses a free end of the screw against the extension bar to retain the extension bar in a selected position. The sight bow mount typically allows the bar to be adjusted only in a horizontal direction relative to the bow. An elevation rail is connected with a remote end of the extension bar, and a sight aperture is mounted on the elevation rail. Accordingly, vertical adjustment of the sight aperture relative to the bow is accomplished by adjusting the elevation rail relative to the extension bar according to the archer's preference.

Owing to the different archery disciplines and different types of competition, there is a need for further ability to vertically adjust an archery sight relative to a bow. The present invention was developed to address this need by providing a bow mounting assembly which affords a variable range of vertical positions of the extension bar relative to a bow which in turn allows for a reduction in the length of the elevation rail. The reduced length of the elevation rail results in a lighter sight mounting assembly.

SUMMARY OF THE INVENTION

Accordingly, it is a primary object of the invention to provide a variable range archery sight bow sight mounting assembly including an elevation bar configured for connection with an archery bow and a mounting bracket configured for adjustable connection with the elevation bar along a first axis. The mounting bracket contains a channel configured to receive an extension bar having a second axis arranged perpendicular to the first axis. The channel affords sliding movement of the extension bar along the second axis relative to the mounting bracket.

The extension bar contains a plurality of threaded openings which are equally spaced and arranged parallel to the first axis. The mounting bracket contains a spaced pair of through openings arranged on opposite sides of the channel and aligned with a selected pair of threaded openings of the elevation bar. A pair of screws pass through the mounting bracket through openings and into the selected pair of threaded openings to connect the mounting bracket with the elevation bar. Accordingly, with the screws removed from the elevation bar, the mounting bracket may be positioned at a selected location along the length of the elevation bar to adjust a position of a sight connected with a remote end of the extension bar. The screws are then passed through the mounting bracket through openings into the corresponding threaded openings of the elevation bar to lock the mounting bracket in the selected location.

A wedge mechanism is connected with a first side of the mounting bracket adjacent to the channel and is operable along a third axis normal to the first and second axes to lock the mounting bracket at a selected location relative to the extension bar. A setting mechanism is connected with a second side of the mounting bracket on the opposite side of the channel to assist in setting the extension bar in a selected location relative to the mounting bracket.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1:
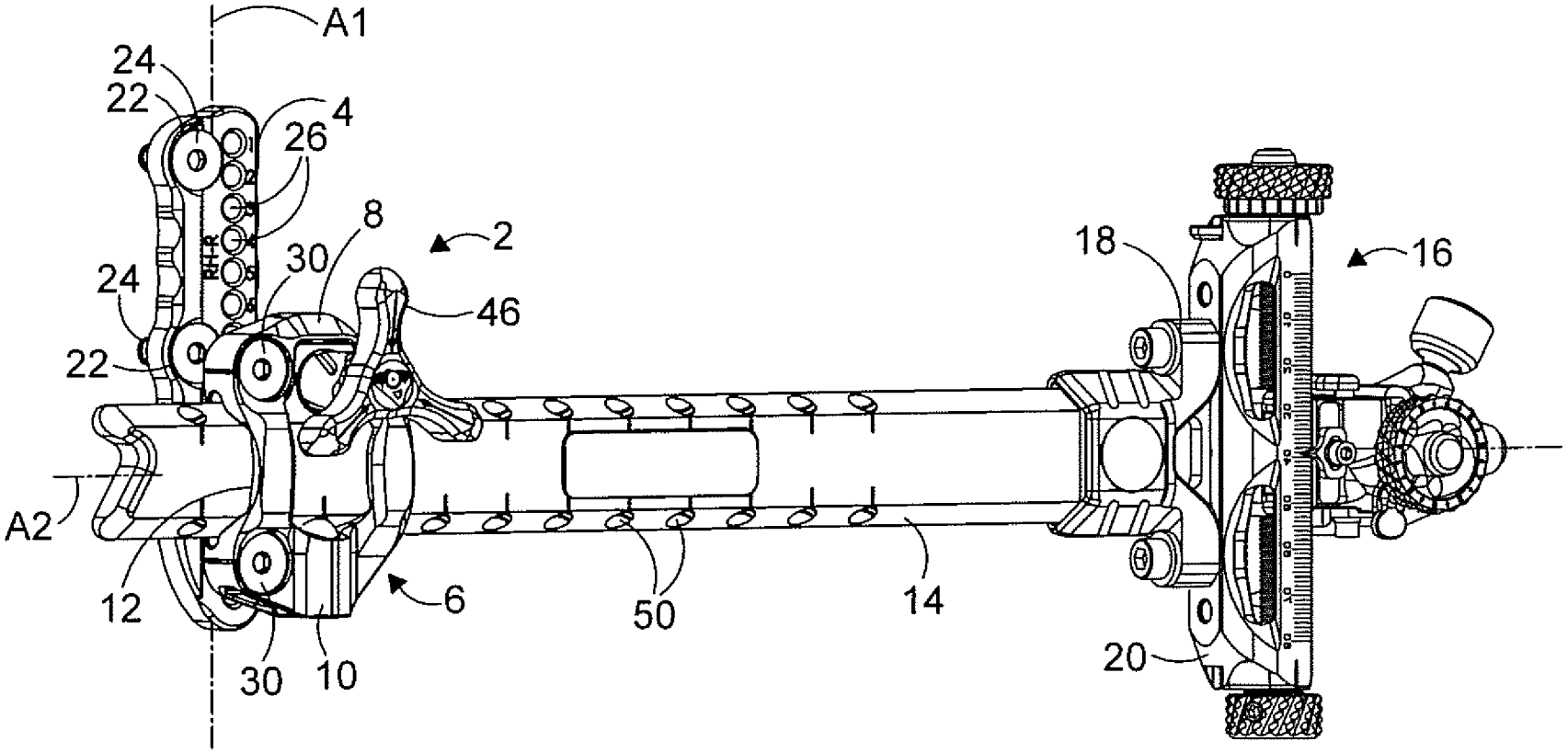
FIGS. 1 and 2 are top perspective views of a recurve variable range bow sight mounting assembly on an extension bar in up and down positions, respectively.
Figure 2:
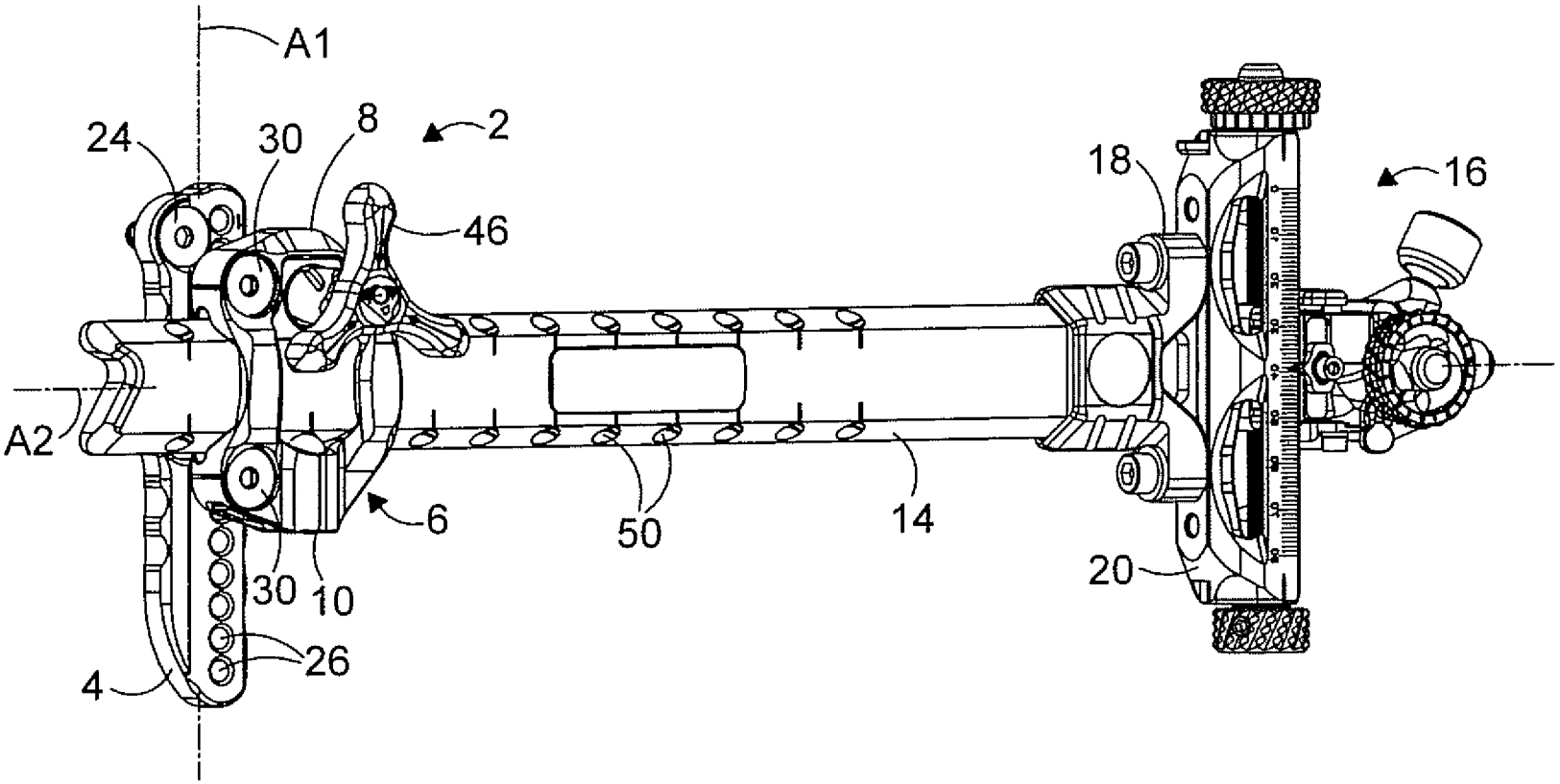
Figure 3:
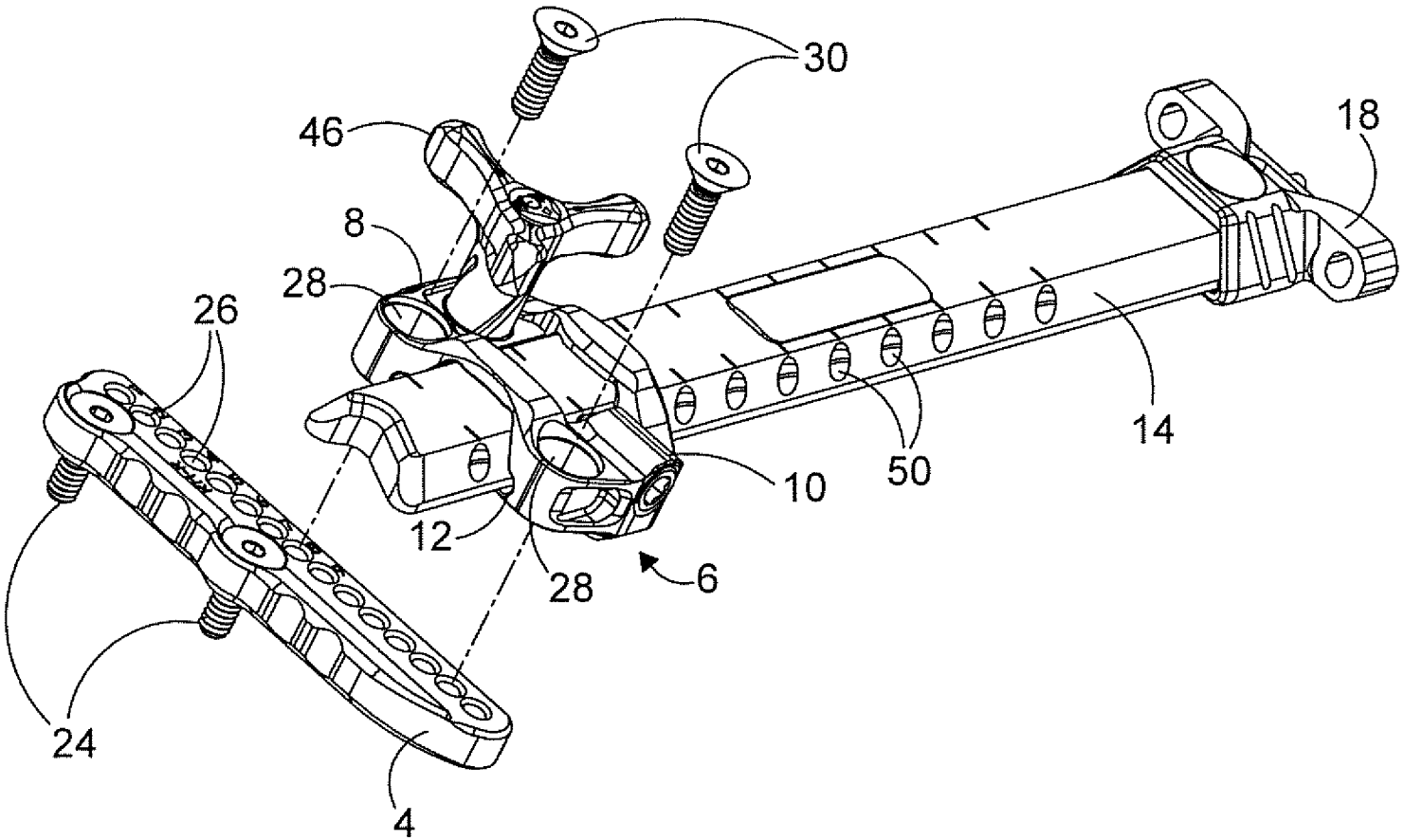
FIG. 3 is an exploded top perspective view of the recurve variable bow sight mounting assembly and extension bar of FIG. 1.
Figure 4:
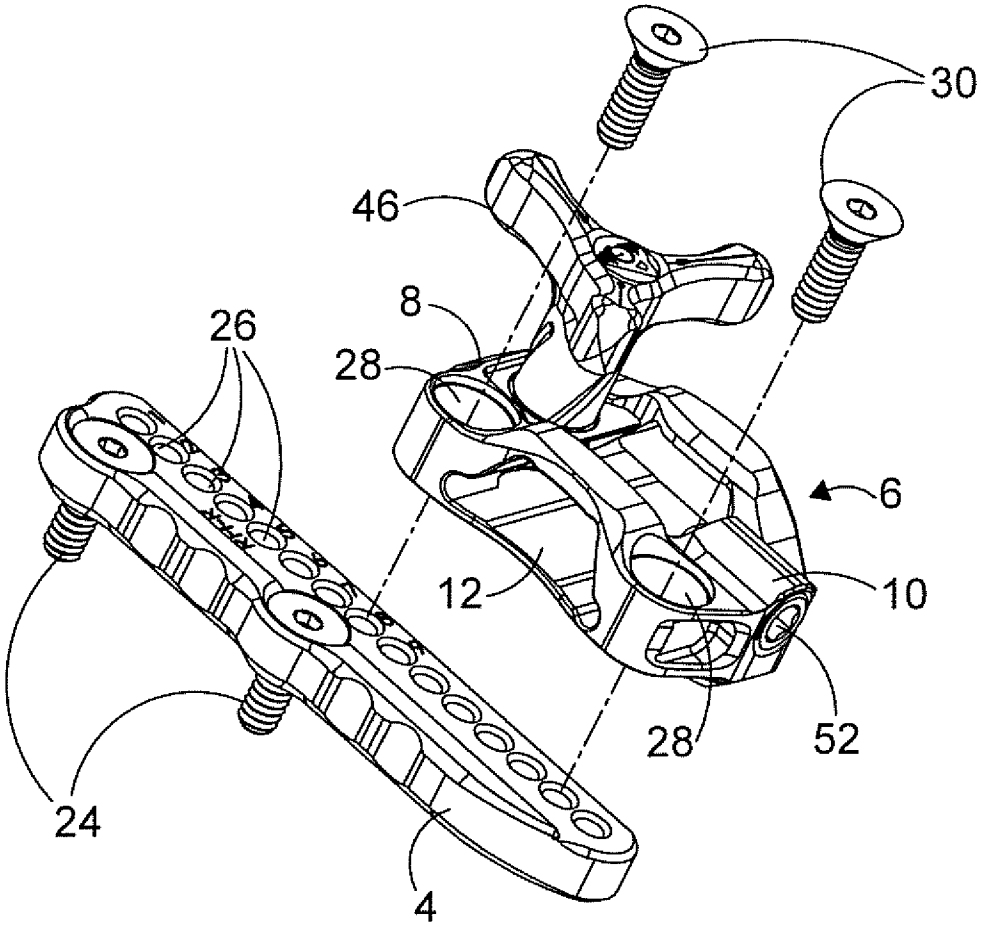
FIG. 4 is an exploded end view of a compound variable range bow sight mounting assembly without an extension bar.

The archery sight variable range bow sight mounting assembly 2 according to the invention includes an elevation bar 4 configured for mounting on a bow (not shown) and a mounting bracket 6, The mounting bracket has a first side 8 and a second side 10 arranged on opposite sides of a channel 12 which is configured to receive an extension bar 14 extending along a second axis A2 perpendicular to the first axis A1 as shown in FIGS. 1-3. In the embodiment shown, the extension bar has a dovetail configuration. The channel of the mounting bracket is configured to match the dovetail configuration of the extension bar so that the extension bar may be displaced relative to the mounting bracket in an axial direction. One end of the extension bar is connected with a sight elevation adjustment mechanism 16 in a conventional manner using a connection assembly 18. An archery sight aperture (not shown) is connected with the extension rail 20 of the sight elevation adjustment mechanism.

The elevation bar is arranged along a first axis A1 and contains a pair of spaced first openings 22 for receiving screws 24 to connect the bar with a bow. In addition, the elevation bar contains a plurality of spaced second openings 26 arranged along a line parallel to the first axis. The second openings are preferably threaded and equally spaced.

As shown in FIG. 3, the mounting bracket 6 contains at least one pair of spaced through openings 28 arranged on opposite sides of the channel 12. The through openings in the mounting bracket are configured for alignment with a selected pair of threaded openings 26 of the elevation bar 4. A pair of screws 30 are provided to connect the mounting bracket 6 with the elevation bar 4. More particularly, the screws pass through the mounting bracket through openings and into the selected pair of threaded openings of the elevation bar. When the screws are tightened, the mounting bracket is securely connected with the elevation bar.

An important feature of the invention is that the mounting bracket can be adjustably connected with the elevation bar at selected locations along the length of the bar by removing the screws 30 from the elevation bar threaded openings and repositioning the mounting bracket along the first axis of the elevation bar to another location along the bar. In this manner, the extension bar is also moved with the mounting bracket to adjust the position of the sight relative to the bow. Accordingly, in use, the first axis of the elevation bar is arranged generally vertically, affording vertical adjustment of the sight. FIG. 1 shows the variable range bow mounting assembly in a bottom position while FIG. 2 shows the mounting assembly in a top position. Of course, additional selected positions of the mounting assembly between the top and bottom positions are available. It will be appreciated that the variable range bow sight mounting assembly 2 provides course sight aperture adjustment and the sight aperture deviation adjustment mechanism 16 at the remote end of the extension bar provides fine sight aperture adjustment.

Figures 5A, 5B, 6A, 6B:
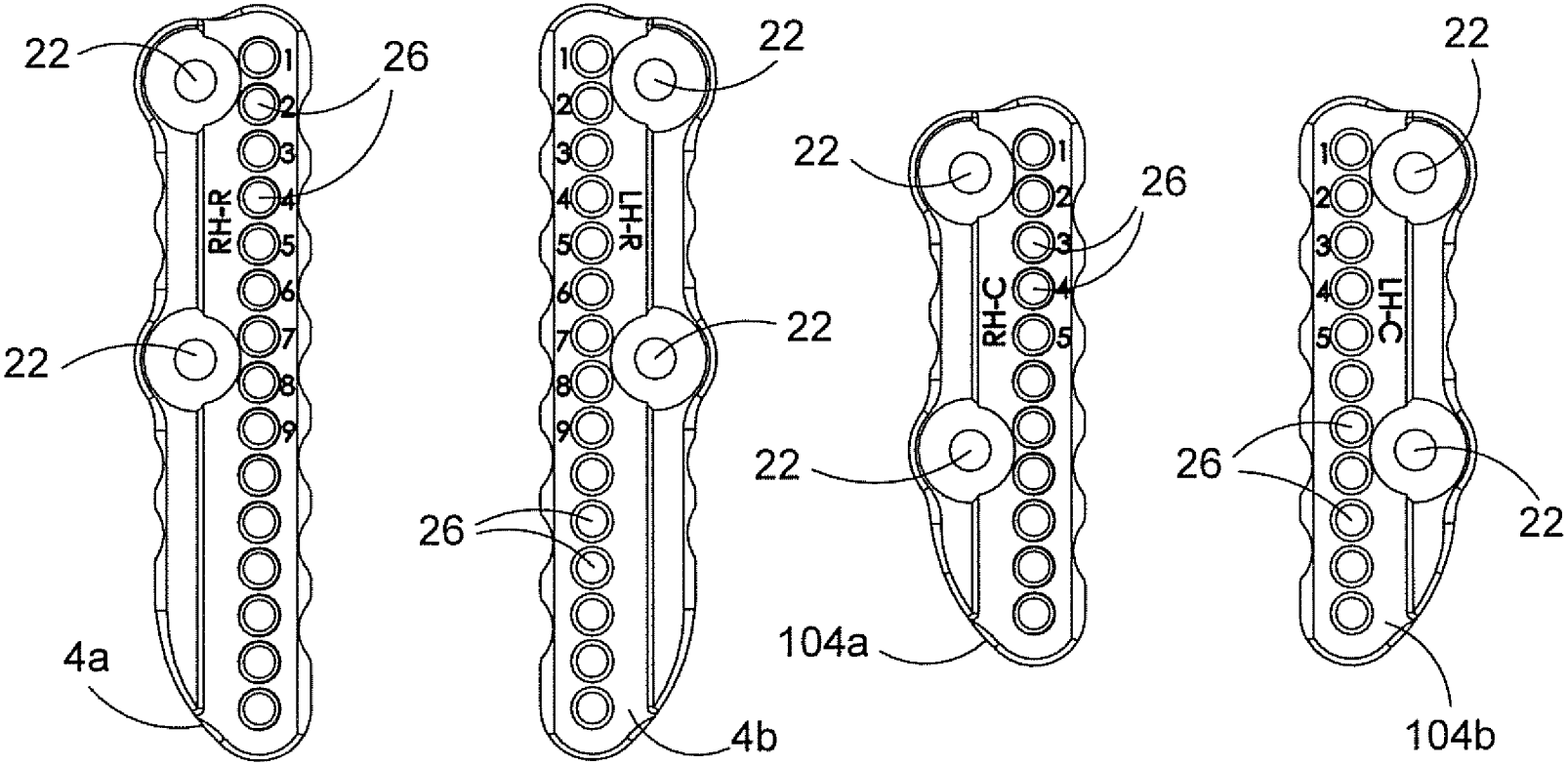
FIGS. 5*a* and 5*b* are plan views of elevation bars, respectively, for a right-band and a left-band recurve variable range bow sight mounting assembly.
FIGS. 6*a* and 6*b* are plan views of elevation bars, respectively, for a right-hand and a left-hand compound variable range bow sight mounting assembly.

The variable range bow sight mounting assembly is suitable for use by both right-handed and left-handed archers and for both recurve and compound disciplines. In FIGS. 5*a* and 5*b* are shown an elevation bar 4*a* for a right-handed archer and an elevation bar 4*b* for a left-handed archer, respectively for a recurve bow. In FIGS. 6*a* and 6*b* are shown an elevation bar 104*a* for a right-handed archer and an elevation bar 104*b* for a left-handed archer for a compound bow.

By way of example only, recurve model elevation bars shown in FIGS. 5*a* and 5*b* include nine different vertical threaded opening attachment locations spaced 7/32 inches apart while the compound model elevation bars shown in FIGS. 6*a* and 6*b* include five different vertical threaded opening locations. The ability to locate the sight vertically in various positions allows for shorter sight aperture elevation rails. A shorter elevation rail may provide only 1.5 inches of elevation travel which is sufficient for fixed distance tournament venues for both compound and recurve archers since the variable range bow sight mounting assembly provides extended vertical adjustment. The archer is able to choose various vertical bow mounting locations to best suit their needs. Other elevation rails of a sight aperture deviation adjustment mechanism may provide 2 inches of vertical elevation travel for use in longer distance tournaments due to the increased ½" of travel relative to the 1.5 inch travel model.

The variable range bow sight mounting assembly thus allows for a reduction in weight due to reducing the elevation rail length at the target end of the sight extension bar. The weight reduction at the target end of the sight system results in a reduction of sight vibrations throughout the bow shot sequence in comparison to heavier longer vertical elevation rail sights that are required in order to achieve sufficient elevation travel.

Figure 7:
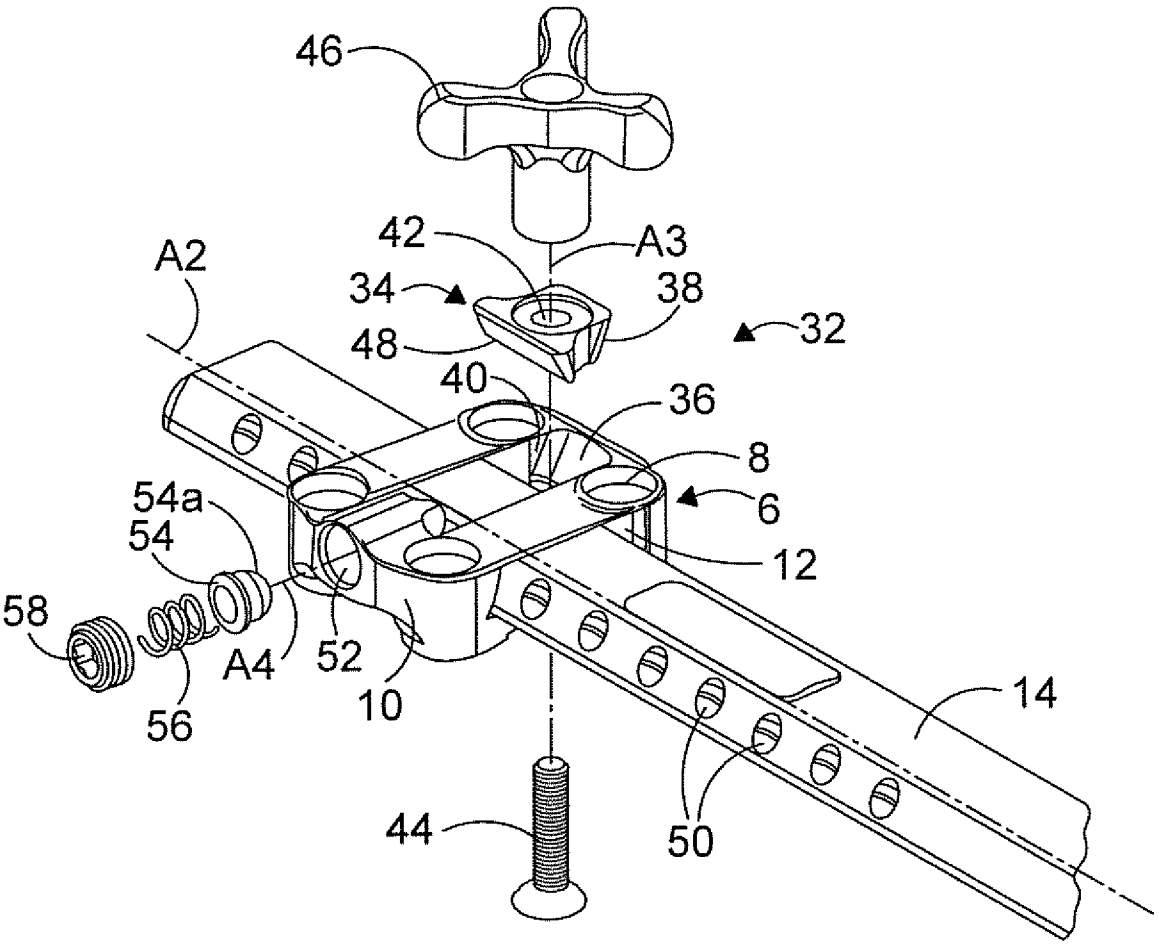
FIG. 7 is an exploded view of the assembly for locking a mounting bracket of the variable range bow sight mounting assembly on an extension bar.

Referring now to FIG. 7, there is shown a wedge mechanism 32 is connected with the first side 8 of the mounting bracket 6 adjacent to the channel 12. The wedge mechanism is operable to lock the mounting bracket at a selected location on the extension bar 14.

The wedge mechanism is connected with the first side 8 of the mounting bracket 6 and is operable to press against the extension bar 14. More particularly, a wedge 34 is arranged in a slot 36 in the mounting bracket first side 8 for displacement relative to the first side 8 of the mounting bracket along a third axis A3 which is arranged normal to the first and second axes. The slot 36 communicates with the channel 12 of the mounting bracket. Surfaces 38 at the corners of the wedge are arranged opposite flat surfaces 40 in the mounting bracket first side 8 adjacent to the slot 36 function as a keyway to maintain the wedge in alignment relative to the mounting bracket. The wedge includes a central opening 42 and the first side 8 of the mounting bracket contains a through opening (not shown) which is aligned with the wedge opening and coaxial with the third axis A3. A screw such as a flat head screw 44 passes through the mounting bracket first aide through opening and through the wedge opening 42. A knob 46 is threadably connected with the free end of the screw.

Rotation of the knob in a locking direction displaces the wedge 34 through the slot 36 in the mounting bracket first side 8 and against the extension bar 14 so that the wedge is tightly secured between the bar and the mounting bracket to lock the extension bar in a selected position relative to the mounting bracket. A surface 48 of the wedge engages a side surface of the extension bar and a surface opposite the surface 48 engages a surface of the mounting bracket first aide which defines the slot 36. Rotation of the knob in the opposite or unlocking direction allows the wedge to move within the mounting bracket slot 36 away from the extension bar to release the bar for sliding movement relative to the mounting bracket 6.

Other assemblies may be used to displace the wedge between its locking and released positions. For example, the knob may include a threaded stem which extends along the third axis A3 and passes through the wedge opening 42 and the mounting plate opening and into a nut below the mounting bracket. Alternatively, the mounting plate opening may be threaded to receive the threaded stem of the knob.

By way of example only, the extension bar has a 30° dovetail configuration which is a standard within the archery product industry. The wedge 34 also has a 30° per taper configuration which mates well with the extension bar to secure the extension bar in a selected position relative to the mounting bracket when the knob is in the locking position to establish the distance of a sight connected with the extension bar from the eye of an archer.

In order to assist with selecting the location of the extension bar relative to the mounting bracket, a setting mechanism is connected with the second side 10 of the mounting bracket 6. As shown in FIGS. 1-3 and 7, the extension bar 14 contains a plurality of spaced recesses 50 in one side thereof. The recesses are preferably equally spaced along the length of the bar. The mounting bracket second side 10 contains a threaded opening 52 which extends along a fourth axis A4 which is normal to both of the second and third axes. The setting mechanism is arranged within the threaded opening 52.

More particularly, the setting mechanism includes a plunger 54 having a forward end portion 54*a* with a radius of curvature which matches the radius of curvature of the recesses 50 in the extension bar. An annular seat is provided on an inner surface of the mounting bracket second side within the threaded opening 52 and a radial projection is provided on the plunger. The projection engages the seat to limit the extent that the plunger extends into the opening 52. When the plunger is fully within the opening and its projection abuts the seat, the forward portion 54*a* of the plunger extends beyond the second side 10 of the mounting bracket into the channel 12 of the mounting bracket and into a recess 50 of the extension bar 14. A coil spring 56 is arranged in the threaded opening and biases the plunger further into the opening. A set screw 58 is threadably connected with the opening 52 to provide the biasing force for the spring. Once assembled, the setting mechanism provides sufficient biasing force on the plunger to engage within an extension bar recess, but not enough force to allow the plunger to retract slightly against the biasing force of the spring so that the plunger exits a selected recess and allows the extension bar to be displaced relative to the mounting bracket when the wedge mechanism is released, to a new position where the plunger engages a different selected recess and the wedge mechanism is operated to lock the extension an in a new selected position. Of course, the setting mechanism can be used to lock the extension bar in locations relative to the mounting bracket between the recesses by positioning the bar at any location along its length and operating the wedge mechanism to lock the bar in place. In such situations, the plunger of the setting mechanism would engage the side portion of the bar, though not necessarily in a recess. Thus, the archer essentially has an infinite number of locations to selectively distance the sight and sight aperture relative to the archer's eye.

It will thus be apparent to those of ordinary skill in the art that the improved variable range bow sight mounting assembly affords quick and simple adjustment of the extension bar relative to the elevation bar 4 and relative to the mounting bracket 6 to allow an archer to properly position an archery sight connected with the extension bar relative to the archer's eye. The wedge mechanism increases the locking force applied between the mounting bracket and the extension bar. Thus, any vibrations emitted by the bow during firing of a shot are minimized or eliminated by the wedge mechanism. This prevents the sight and the sight aperture from being displaced during firing of a shot and thus improves the accuracy of the archer.

The elevation bar and the mounting bracket, the screw, wedge and knob of the wedge mechanism, as well as the components of the setting mechanism are preferably formed of a rigid material such as metal, synthetic plastic or a composite of such materials.

While the preferred forms and embodiments of the disclosure have been illustrated and described, it will be apparent to those of ordinary skill in the art that various changes and modifications may be made without deviating from the concepts set forth above.

What is claimed is:

1. A variable range archery bow sight mounting assembly, comprising (a) an elevation bar having a planar surface extending along a first axis and configured for connection with a bow; and (b) a mounting bracket configured for adjustable sliding connection with said elevation bar planar surface along the first axis at a selected location along a length of said elevation bar, said mounting bracket containing a channel configured to receive an extension bar having a second axis arranged perpendicular to the first axis, said channel affording sliding movement of the extension bar along the second axis relative to said mounting bracket.

2. A variable range archery bow sight mounting assembly as defined in claim 1, wherein said elevation bar contains a plurality of spaced threaded openings linearly arranged parallel to said first axis.

3. A variable range archery bow sight mounting assembly as defined in claim 2, wherein said threaded openings are equally spaced along said elevation bar.

4. A variable range archery bow sight mounting assembly as defined in claim 3, wherein said mounting bracket contains a spaced pair of through openings arranged on opposite sides of said channel, respectively, said through openings being aligned with a selected pair of threaded openings.

5. A variable range archery bow sight mounting assembly as defined in claim 4, and further comprising a pair of screws which pass through said mounting bracket through openings into said selected pair of threaded openings for connecting said mounting bracket with said elevation bar, whereby when said pair of screws are removed from said elevation bar, said mounting bracket may be positioned at the selected location along the length of said elevation bar to adjust a position of a sight connected with a remote end of the extension bar and said screws may be connected with said elevation bar to lock said mounting bracket into the selected location.

6. A variable range archery bow sight mounting assembly as defined in claim 1, wherein said elevation bar contains at least one fastening device for connecting said elevation bar with a bow.

7. A variable range archery bow sight mounting assembly as defined in claim 6, wherein said at least one fastening device comprises a pair of spaced screws.

8. A variable range archery bow sight mounting assembly as defined in claim 1, and further comprising a wedge mechanism connected with a first side of said mounting bracket adjacent to said channel and operable to lock the mounting bracket at a selected location relative to the extension bar.

9. A variable range archery bow sight mounting assembly as defined in claim 8, wherein said wedge mechanism includes a tapered wedge containing an opening and a screw which passes through a first opening in said first side of said mounting bracket and through said wedge opening, said screw, said wedge opening and said mounting bracket first opening being co-axial along a third axis normal to the first and second axes.

10. A variable range archery bow sight mounting assembly as defined in claim 9, wherein said wedge mechanism further includes a knob connected with a free end of said screw extending from said wedge opening, said knob being operable in a locking direction to displace said wedge along said third axis against the extension bar and said mounting bracket to lock said extension bar in the selected location relative to said mounting bracket, said knob further being operable in an unlocking direction to release said wedge for displacement along said third axis away from the extension bar and said mounting bracket to release said extension bar for sliding movement relative to said mounting bracket.

11. A variable range archery bow sight mounting assembly as defined in claim 10, wherein said mounting bracket first side contains a slot configured to receive a portion of said wedge and to align said wedge relative to said mounting bracket.

12. A variable range archery bow sight mounting assembly as defined in claim 8, and further comprising a setting mechanism connected with a second side of said mounting bracket opposite said first side on another side of said channel to assist in setting said extension bar in a selected location relative to said mounting bracket.

13. A variable range archery bow sight mounting assembly as defined in claim 12, wherein said mounting bracket second side contains a threaded opening having a fourth axis parallel to the first axis, said setting mechanism being arranged in said threaded opening.

14. A variable range archery bow sight mounting assembly as defined in claim 13, wherein said setting mechanism includes a plunger, a spring adjacent to said plunger, and a set screw threaded into said second opening to press said spring and said plunger toward said extension bar.

* * * * *